US007234922B2

(12) United States Patent
Kunkler et al.

(10) Patent No.: US 7,234,922 B2
(45) Date of Patent: Jun. 26, 2007

(54) PUMP PRESSURE LIMITING ENGINE SPEED CONTROL AND RELATED ENGINE AND SPRINKLER SYSTEM

(75) Inventors: Kevin J. Kunkler, Cincinnati, OH (US); John T. Whitney, Jr., Blanchester, OH (US)

(73) Assignee: Clarke Fire Protection Products, Inc., Cincinnati, OH (US)

( * ) Notice: Subject to any disclaimer, the term of this patent is extended or adjusted under 35 U.S.C. 154(b) by 434 days.

(21) Appl. No.: 10/808,183

(22) Filed: Mar. 24, 2004

(65) Prior Publication Data

US 2004/0247448 A1 Dec. 9, 2004

Related U.S. Application Data

(63) Continuation-in-part of application No. 10/829,483, filed on Oct. 9, 2003, which is a continuation-in-part of application No. 10/142,206, filed on May 9, 2002, now abandoned.

(51) Int. Cl.
*F04B 49/00* (2006.01)

(52) U.S. Cl. ..... 417/34; 417/53

(58) Field of Classification Search ..... 417/34, 417/53

See application file for complete search history.

(56) References Cited

U.S. PATENT DOCUMENTS

| | | | | |
|---|---|---|---|---|
| 2,820,414 A | | 1/1958 | Fejedelem | |
| 2,931,305 A | | 4/1960 | Stratton | |
| 3,116,694 A | | 1/1964 | Eberhardt | |
| 3,213,605 A | | 10/1965 | Welden | |
| 3,235,009 A | | 2/1966 | Nelson | |
| 3,459,131 A | | 8/1969 | Senf | |
| 3,592,220 A | | 7/1971 | Reinke | |
| 3,613,520 A | | 10/1971 | Worden | |
| 3,977,603 A | | 8/1976 | Magee, Jr. | |
| 3,997,282 A | | 12/1976 | Thomas et al. | |
| 4,024,711 A | | 5/1977 | Russell, Jr. | |
| 4,158,529 A | | 6/1979 | Nonnemacher et al. | |
| 4,492,525 A | | 1/1985 | Bilyeu | |
| 4,611,290 A | | 9/1986 | Henningsen et al. | |
| 5,035,580 A | | 7/1991 | Simonette | |
| 5,155,996 A | * | 10/1992 | Tatsumi et al. | 60/431 |
| 5,410,878 A | * | 5/1995 | Lee et al. | 60/327 |
| 5,848,877 A | * | 12/1998 | Dill et al. | 417/44.2 |
| 5,888,051 A | * | 3/1999 | McLoughlin et al. | 417/53 |

* cited by examiner

*Primary Examiner*—William H. Rodriguez
(74) *Attorney, Agent, or Firm*—Thompson Hine LLP

(57) ABSTRACT

A sprinkler system for building includes an internal combustion engine which operates a water pump. The water pump in turn forces water through pipes to sprinkler heads. The engine is at least in part controlled by a throttle control mechanism which is responsive to pressure.

24 Claims, 7 Drawing Sheets

PUMP PRESSURE LIMITING ENGINE SPEED CONTROL AND RELATED ENGINE AND SPRINKLER SYSTEM

RELATED APPLICATIONS

This application is a continuation-in-part of U.S. patent application Ser. No. 10/829,483, filed on Oct. 9, 2003 by Kevin Kunkler and John Whitney, entitled "Pump Pressure Limiting Speed Control," which is in turn a continuation-in-part of U.S. patent application Ser. No. 10/142,206, filed on May 9, 2002 now abandoned by John Whitney, titled "Pump Pressure Limiting Engine Speed Control.

BACKGROUND

Building sprinkler systems are designed to provide pressurized water to extinguish fires during emergency situations. A pump is used to provide the necessary water pressure. These pumps are typically powered by an electric motor, however many are often powered by internal combustion engines. The present application relates to internal combustion engine systems.

Such sprinkler systems are designed for a defined flow rate and pressure. For a given engine/pump combination, the discharge line pressure, from the pump, is dependent on the fluid flow rate through the system and the pressure of the water being supplied to the pump (called suction pressure). The pressure of the water at the pump suction often has a wide range between its high and low resulting in an equally wide contribution to pump output pressure variances. At a constant engine/pump RPM (Revolutions Per minute). The line pressure will increase as the fluid flow rate decreases through the system. Further, at a fixed throttle setting, as the fluid flow rate decreases, the load on the engine also decreases resulting in an increase in engine rpm, thereby further increasing pressure produced by the pump (this is referred to as the engine droop). The net effect is to increase the pressure, which a sprinkler system must be able to withstand. This basically means stronger more expensive sprinkler system components including water pipes, fittings and sprinklers. Sprinklers are rated for specific operating pressures. This establishes the limits of the system pressures. Some types of sprinklers are further limited to smaller more specific pressure ranges further limiting system pressure ranges.

SUMMARY

The present application is premised on the realization that the need for higher pressure rated sprinkler systems can be avoided by utilizing an engine throttle control which is responsive to the output pressure of the pump. As the pump pressure increases above a defined pressure, a control mechanism is utilized to retard the throttle, thereby reducing engine RPM and in turn maintaining a relatively constant system pressure.

The control mechanism may be a piston which is attached to the throttle and forced in a direction that retards the throttle when water pressure is increased beyond a given limiting pressure. The piston is spring biased so that when the system pressure decreases, the throttle will return to its normal setting to operate the pump within design parameters. Knowing the pressure at the rated flow of the pump allows one to adjust the control mechanism to maintain this pressure even at low flow rates thereby eliminating the need for the more expensive plumbing created by undesirable pressure.

The objects and advantages of the present invention will be further appreciated in light of the following detailed description and drawings.

DETAILED DESCRIPTION

Figure 1:
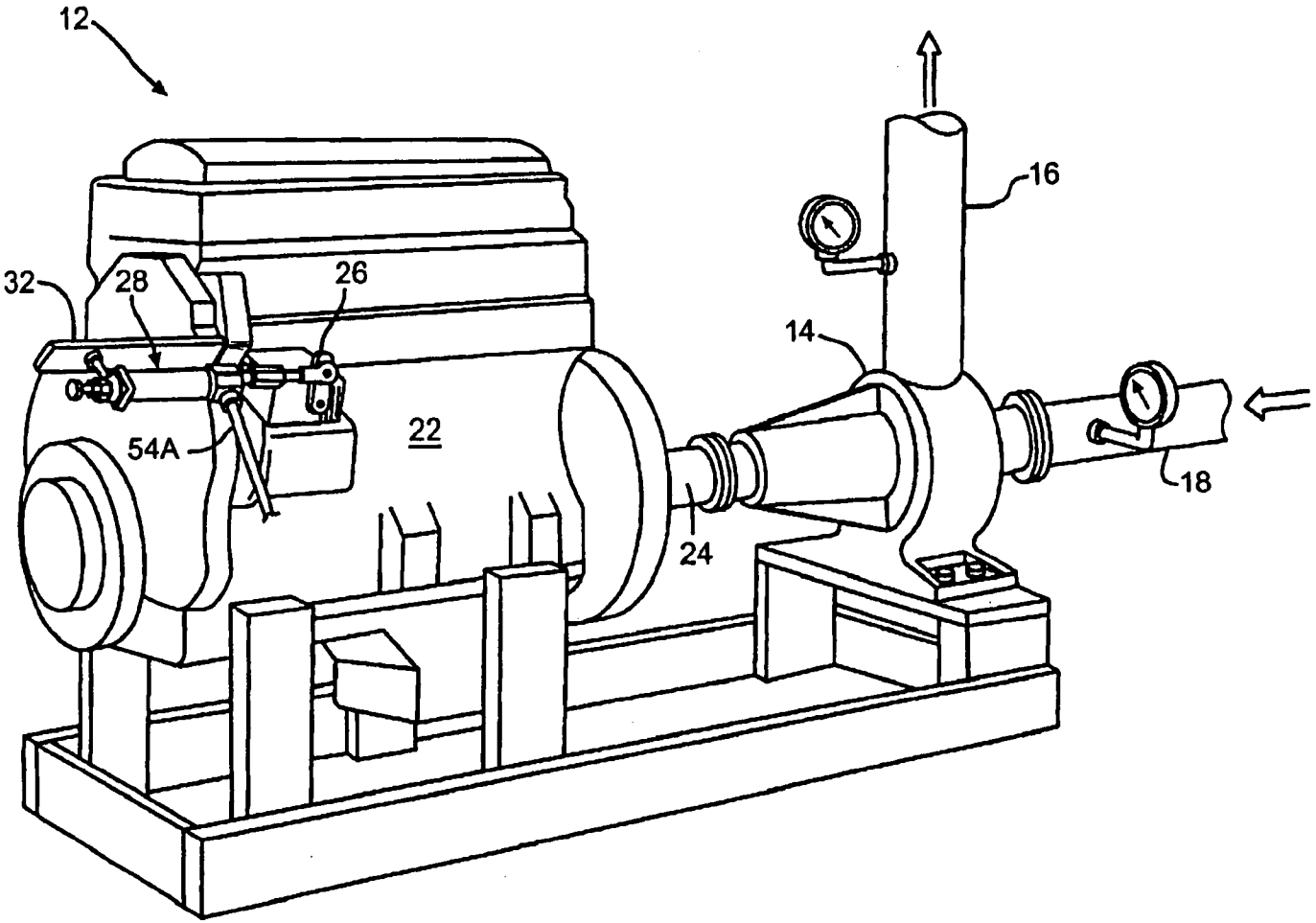
FIG. 1 presents a pictorial view of a typical internal combustion engine driven pump installation as typically used in a fire prevention sprinkler system.

FIG. 1 presents a pictorial view of a typical internal combustion engine 22 coupled to a typical fire prevention sprinkler system pump 14 that is suitable for application of the below-described features and techniques.

As shown in FIG. 1, sprinkler system 12 includes a pump 14 which directs water from the pump inlet, or suction, pipe 18 and through outlet pipe 16 to sprinkler heads (not shown). The pump 14 is in turn operated by internal combustion engine 22, which is preferably a diesel engine but could be another type of internal combustion engine. Engine 22 drives shaft 24 which in turn operates pump 14.

The RPM of engine 22 and thereby shaft 24 is controlled by throttle lever 26. Throttle lever 26 is operatively connected to a control mechanism 28, which is mounted on engine 22 by bracket 32. The elements of control mechanism 28 and its functional operation are described below.

Figures 2, 2A:
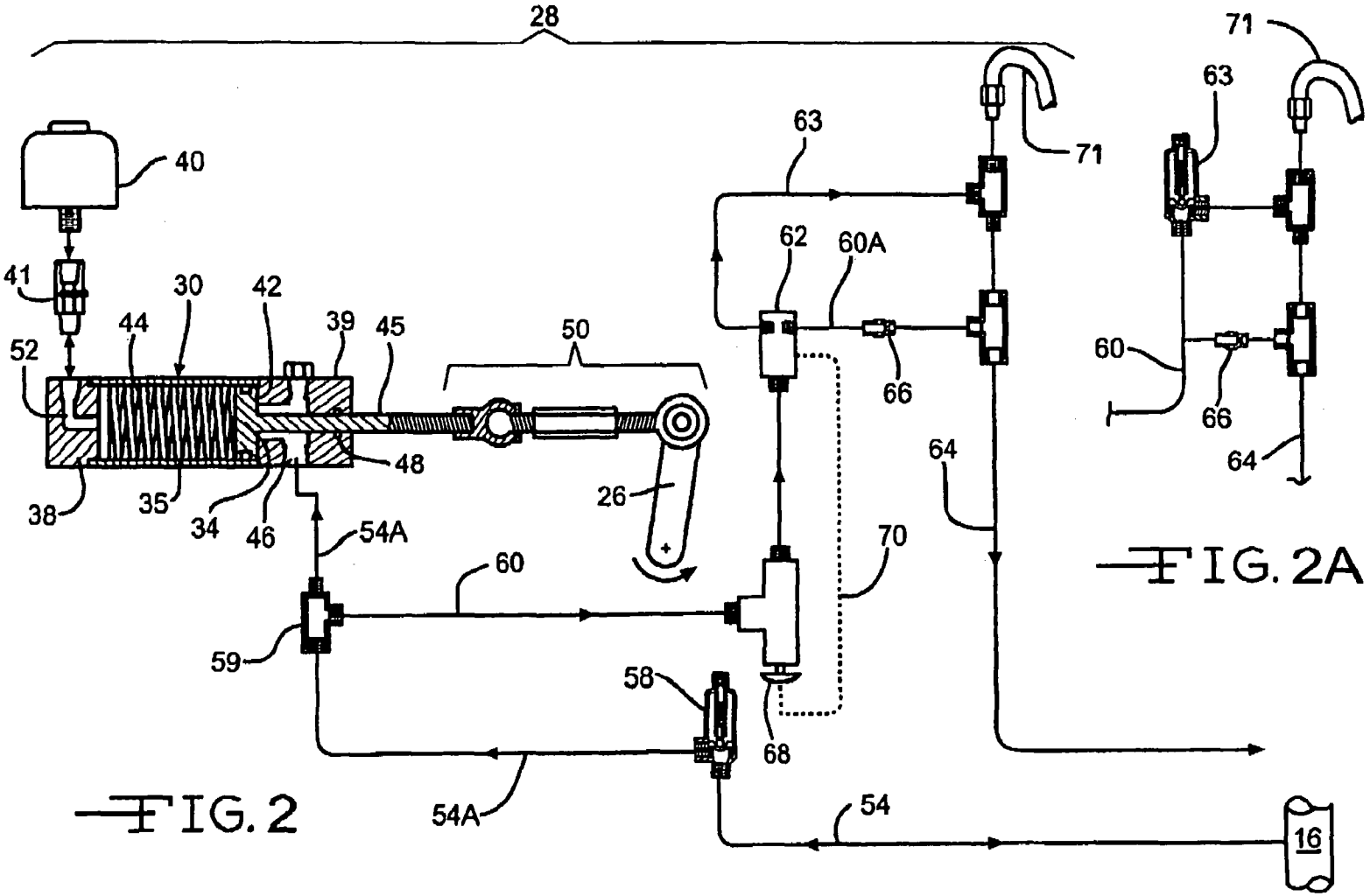
FIG. 2 presents a schematical diagram illustrating a preferred engine speed control system and its pertinent operating elements
FIG. 2A presents an alternate arrangement for the over-pressure control valve which is hydraulically controlled.

Turning now to FIG. 2, throttle control mechanism 28 comprises a throttle control actuator assembly 30 fabricated from an open ended cylinder 35. A first end block 38 closes off and seals the first end of cylinder 35. A second end block 39 closes off and seals the opposite end of cylinder 35. A slidable piston 34 is received within cylinder 35 as illustrated in FIG. 2. Compression spring 44 extends from end block 38 to piston 34 thereby biasing piston 34 against shoulder 42 of end block 39 which corresponds to the full open throttle position.

Within end block 39 is fluid receiving chamber 46. A piston rod 45, integral with piston 34, extends axially through chamber 46 extending beyond end block 39, as illustrated in FIG. 2, and connects to throttle linkage 50, the length of which is adjustable to facilitate proper setting of the control mechanism 28. Piston rod 45 is appropriately sealed by an o-ring 48 thereby preventing fluid linkage around the piston rod.

A fluid dampening reservoir 40 is attached to end block 38 via orifice 41 thereby fluidly communicating with cylinder 35 through fluid channel 52 within end block 38. Orifice 41 functions to dampen fluid pressure surges that may otherwise be transmitted directly to dampening reservoir 40.

Fluid pressure is received within fluid chamber 46, from tube 54A, and acts upon slidable piston 34 thereby compressing spring 44 whereby piston rod 45 translates to the left, as viewed in FIG. 2, thereby rotating throttle lever 26 counterclockwise thereby retarding throttle lever 26.

In operation, pump discharge pressure is received, from pump discharge 16, in line 54. Relief valve 58 is normally closed and may be an adjustable type valve to facilitate establishing the proper set point. If the pump discharge pressure exceeds the set point of relief valve 58, which is calibrated to maintain normally 170 psi, but may range from 110 to 240 psi, in pump discharge line 16, relief valve 58 opens thereby permitting fluid flow through line 54A, control line 60, exhaust valve 62, and through orifice 66 into drain 64. As fluid flows through orifice 66 a controlled back pressure is created in control line 60 and line 54A communicating with fluid chamber 46 in throttle actuator 30. Thus the pressure acting upon piston 34 is substantially reduced below the pump discharge pressure in pump discharge 16, but the pressure acting upon piston 34 still varies as the pressure in pump discharge 16 varies. However, the pressure communicated to fluid chamber 46 does not necessarily have to vary in direct proportion to variations in the pressure of pump discharge 16.

At start up and/or during normal steady state operating conditions throttle 26 and the throttle control actuator assembly 30 are positioned as illustrated in FIG. 2. Compression spring 44 is biasing piston 36 and its associated piston rod 45 to the right as viewed in FIG. 2. In this configuration throttle lever 26 is positioned in its full open position whereby pump 14 is providing a predetermined water flow rate and working pressure at rated operating speed throughout the sprinkler system, not shown, by way of discharge pipe 16. As the system is operating, the line pressure of discharge pipe 16 is also present in inlet tube 54. So long as the pressure within discharge pipe 16 and inlet tube 54 is below a pre set pressure limit of relief valve 58, typically 170 psi, relief valve 58 remains closed thereby preventing any fluid flow, or preventing enough flow against orifice 66 to create sufficient back pressure to produce movement of piston 34, into inlet line 54A that would overcome the bias from spring 44 to move the piston. Thus throttle control assembly 30 is unaffected and throttle lever 26 remains unchanged.

However, in the event line pressure in pump discharge pipe 16 and inlet tube 54 rise above the set limit of 170 psi, relief valve 58 opens thereby permitting fluid flow into inlet line 54A. Fluid flow now occurs through inlet line 54A and through control line 60, to and through exhaust valve 62, which is open to line 60A. As the fluid flow passes through line 60A, it passes through orifice 66 and into drain line 64. Orifice 66 acts to restrict the fluid flow through control line 60 thereby causing a controlled back pressure throughout control line 60 and into chamber 46, within throttle control assembly 30 by way of back pressure line 54A. Thus the fluid pressure acting upon piston 34 is greatly reduced from that of discharge pipe 16. Nevertheless as line pressure within discharge pipe 16 varies the back pressure caused by orifice 66 will also vary accordingly causing piston 34 to move against compression spring 44 thereby retarding and/or advancing throttle lever 26. Once line pressure within discharge pipe 16 drops below the set point, relief valve 58 will close thereby preventing or reducing further fluid flow into control lines 54A, 60, 60A. Fluid flow through orifice 66 continues such that pressure within the control lines 54A, 60, 60A will then decay to a pressure below the pressure required to overcome the bias of the spring 44 or to atmospheric, the pressure existent within drain 64. Compression spring 44 will then bias piston 34 to the right, against shoulder 42 thereby resetting throttle lever 26 to its normal operating position.

Fluid damping reservoir 40, fluidly communicating with cylinder 35 through conduit 52, is preferably provided to dampen rapid fluid pressure fluctuations that may occur within control line 54A, fluid chamber 46 and acting on piston 34.

A further method of damping pressure fluctuations that may occur in control line 54A is to place an orifice within control line 54A between relief valve 58 and fluid chamber 46 and/or between valve 58 and pump discharge 16.

During operation of the throttle control system 28, pressure switch 68 constantly monitors the fluid pressure within control line 60. In the event of orifice 66 becoming artificially restricted and the fluid pressure within control line 60 becoming artificially high, an electrical signal is transmitted through electrical connection 70 to three way exhaust valve 62 thereby opening the valve to relief line 63 and overflow hose 71, thereby dumping the fluid pressure within control line 60 and throttle control actuator assembly 30 causing piston 34 to be biased by spring 44 to the right against shoulder, thereby returning throttle 26 to its normal operating position. Thus, the system provides full throttle operating mode in the event of failure of orifice 66.

Figure 3:
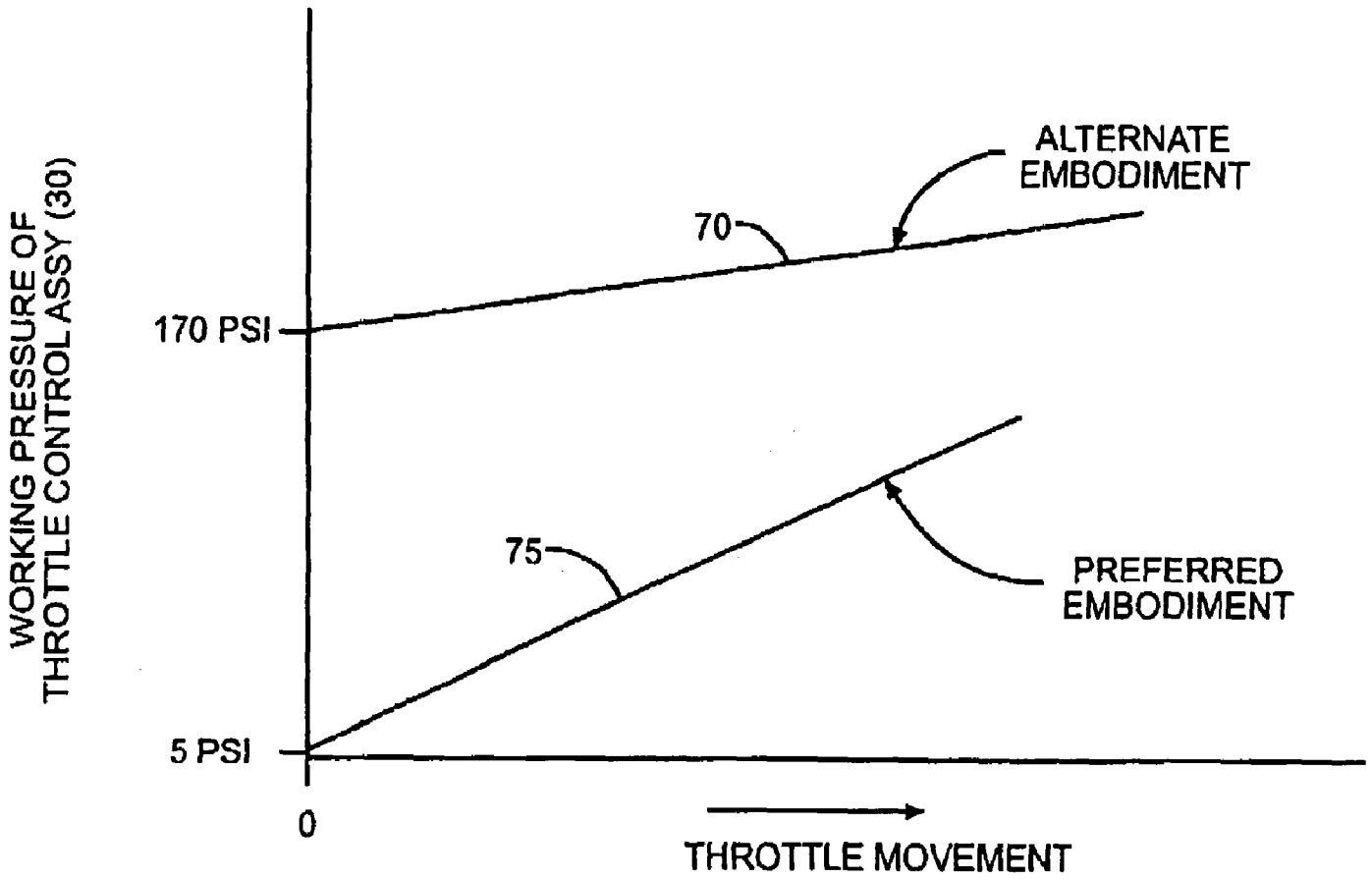
FIG. 3 presents a comparison of the fluid pressure necessary to obtain a given throttle movement for the two embodiments of the present invention presented herein.

As illustrated by curve 75 in FIG. 3, by employing the above-described embodiment, the fluid pressure acting upon piston 36 is significantly reduced to the back pressure value created by orifice 66, within input lines 60 and 54A, as fluid passes therethrough. Thus throttle control assembly 30 need not be designed to withstand operational fluid pressures of 170 psi and above.

FIG. 3 presents a plot of the fluid pressure acting upon piston 34 as a function throttle movement, for a sprinkler system embodying the above-described embodiment, as compared to the fluid pressure acting upon piston 156 in the alternate embodiment described herein below. Referring to FIG. 3, curve 75 represents a typical plot of the pressure acting upon piston 34 vs. throttle, or piston movement and curve 70 typically represents the pressure acting upon piston 156 vs. throttle or piston movement in the alternate embodiment described below. As seen in FIG. 3 the above-described embodiment requires a greater pressure change, or delta P than the alternate embodiment represented by curve 70. Therefore, the above-described embodiment offers a more sensitive control of throttle movement than that offered by the alternative embodiment below. In one implementation, as the output pressure of the pump varies between about 170 psi and about 175 psi, the controlled backpressure produced in chamber 46 varies between about 5 psi and 30 psi. Thus, the backpressure range (5-30 psi, or 25 psi) is about five time larger than the output pressure range (170-175 psi, or 5 psi). In other implementations the backpressure range could be at least four, at least three or at least two times larger than the output pressure range.

FIG. 2A presents an alternate system for exhaust valve 62 and its associated pressure sensing switch 68. As illustrated in FIG. 2A exhaust valve 62 and pressure sensing switch 68 may be replaced by a typical, mechanically operated, pressure relief valve 63. Thus the function of exhaust valve 62 and pressure sensing switch 68 may be replaced by a mechanical as opposed to an electrically functioning pressure relief system.

As illustrated in FIG. 3, the fluid pressure acting upon piston 156 in the alternate embodiment described below, represented by curve 70, is equal to 170 psi or higher and equal to the line pressure of pump discharge-16 immediately upon the opening of the relief valve 58 and continues to climb as discharge pressure 16 climbs.

Figure 6:
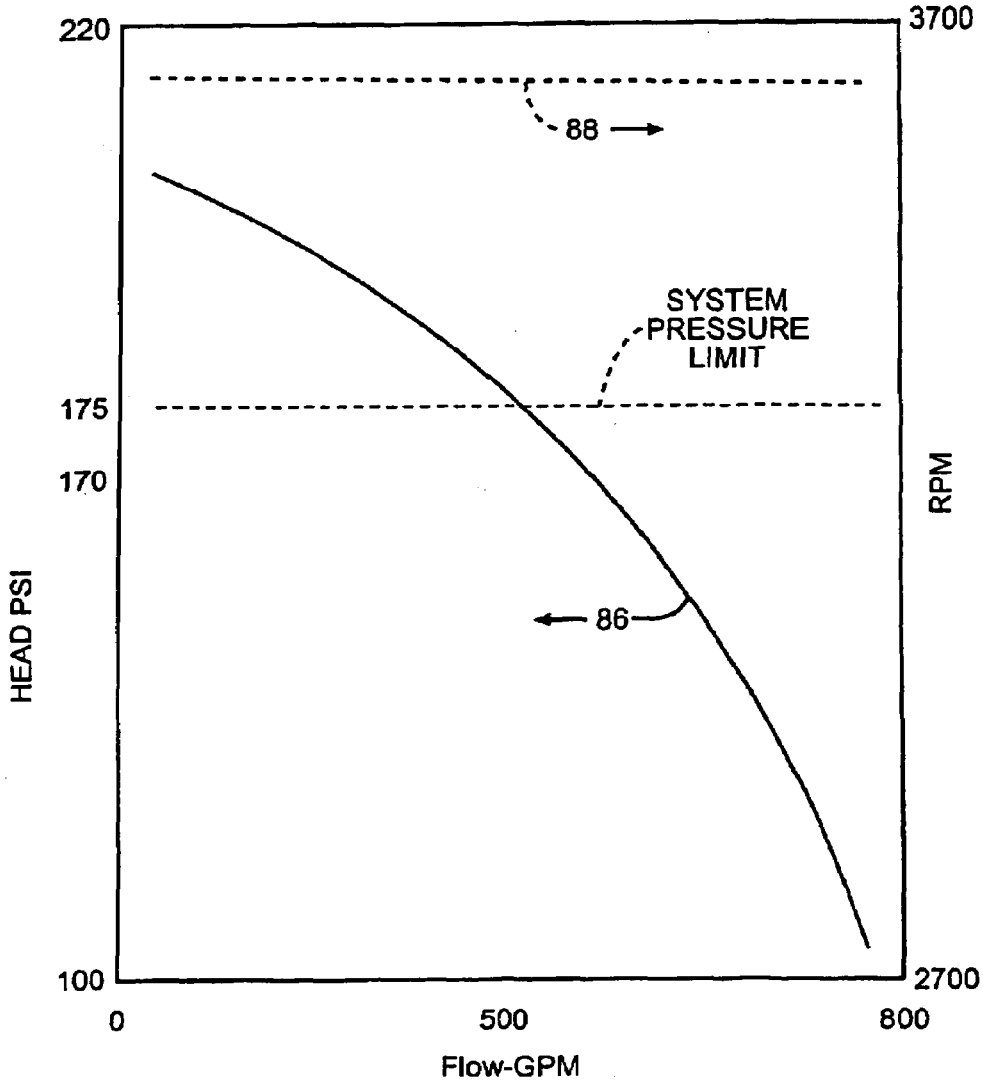
FIG. 6 presents typical system performance of flow versus system pressure and flow versus engine RPM when a throttle control mechanism is not installed on the engine.

FIG. 6 presents a plot of the fluid pressure versus flow, curve 86, within pump discharge line 16 when the pressure control feedback feature is not present. As illustrated, the pump discharge pressure significantly exceeds the system pressure limit of approximately 175 psi. Curve 88 illustrates the associated engine/pump speed versus flow.

Figure 7:
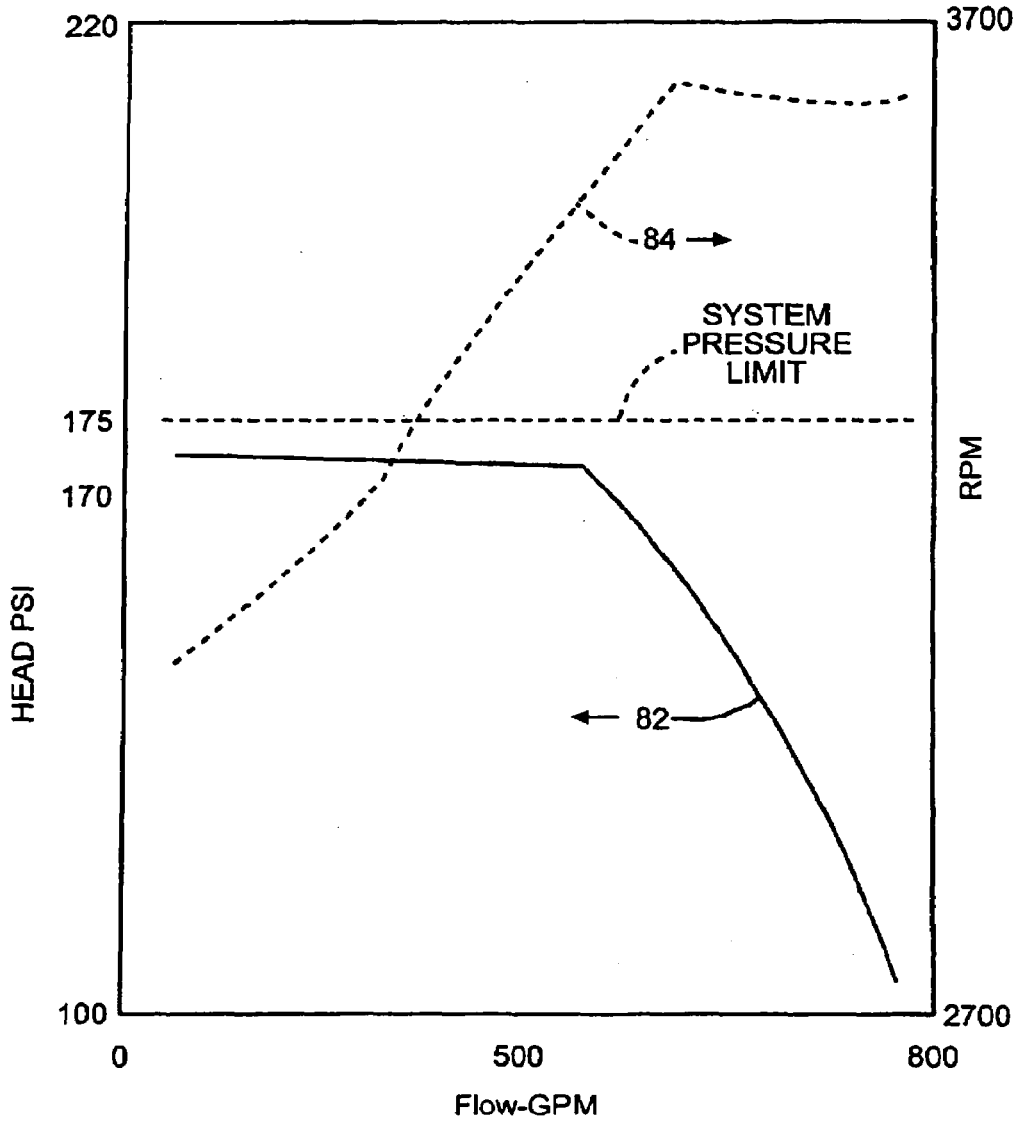
FIG. 7 presents typical system performance of flow versus system pressure and flow versus engine RPM when a throttle control mechanism is installed on the engine.

FIG. 7 presents a plot of the fluid pressure versus flow, curve 82, within pump discharge line 16 when the system is activated to overcome a pump discharge pressure reaching or exceeding the set point of 170 psi. of relief valve 58. As illustrated, the pump discharge pressure is relatively constant at about 170 psi. Curve 84 illustrates the associated engine/pump speed versus flow.

The various portions of control mechanism 28 can be integrated with a combustion engine 22 such that, upon installation of the engine in a sprinkler system application, only the connections of lines 54, 64 and overflow 71 need to be made. Such integration may include incorporating certain components, such as relief valve 58, within a protective housing or cover so as to prevent tampering.

Once integrated with an engine 22, the control mechanism 28 may be calibrated as part of the engine manufacturing process, prior to delivery of the engine to a site for installation in a sprinkler system. In particular, a test station may include a pressure unit for simulating the variable output pressure of a sprinkler system pump. The pressure unit is connected to the pump side of the pressure relief valve 58, with the pressure output by the pressure unit initially below the predetermined or threshold pressure that will trigger control mechanism. The length of throttle linkage 50 is then adjusted to establish the desired engine RPM for 'full throttle' operation of the engine 22. The pressure unit is then operated to increase the pressure applied to the pump side of pressure relief valve 58 to determine at what pressure the control mechanism is triggered to move the throttle and reduce engine speed. If the control mechanism is not triggered at the desire pressure, the pressure relief valve is adjusted. The sequence of operating the engine at full throttle, bringing the pressure of the pressure unit up to the desired pressure trigger point and adjusting the pressure relief valve is repeated as necessary until the engine and control mechanism has been calibrated to respond at the desired pressure trigger point. After the proper set point for the pressure relief valve 58 has been established, a cover, plate or other housing can be placed over the valve 58 to prevent field tampering. In this manner, when installed in a sprinkler system in the field, the engine 22 and associated control mechanism 28 should not require adjustment.

It is recognized that the control mechanism 28 could be sold as a retrofit kit for application to existing sprinkler system engines already in the field. In such cases a test station could be established for calibrating the retrofit control mechanism 28 per a procedure similar to that described above.

Alternate Embodiment

Figure 4:
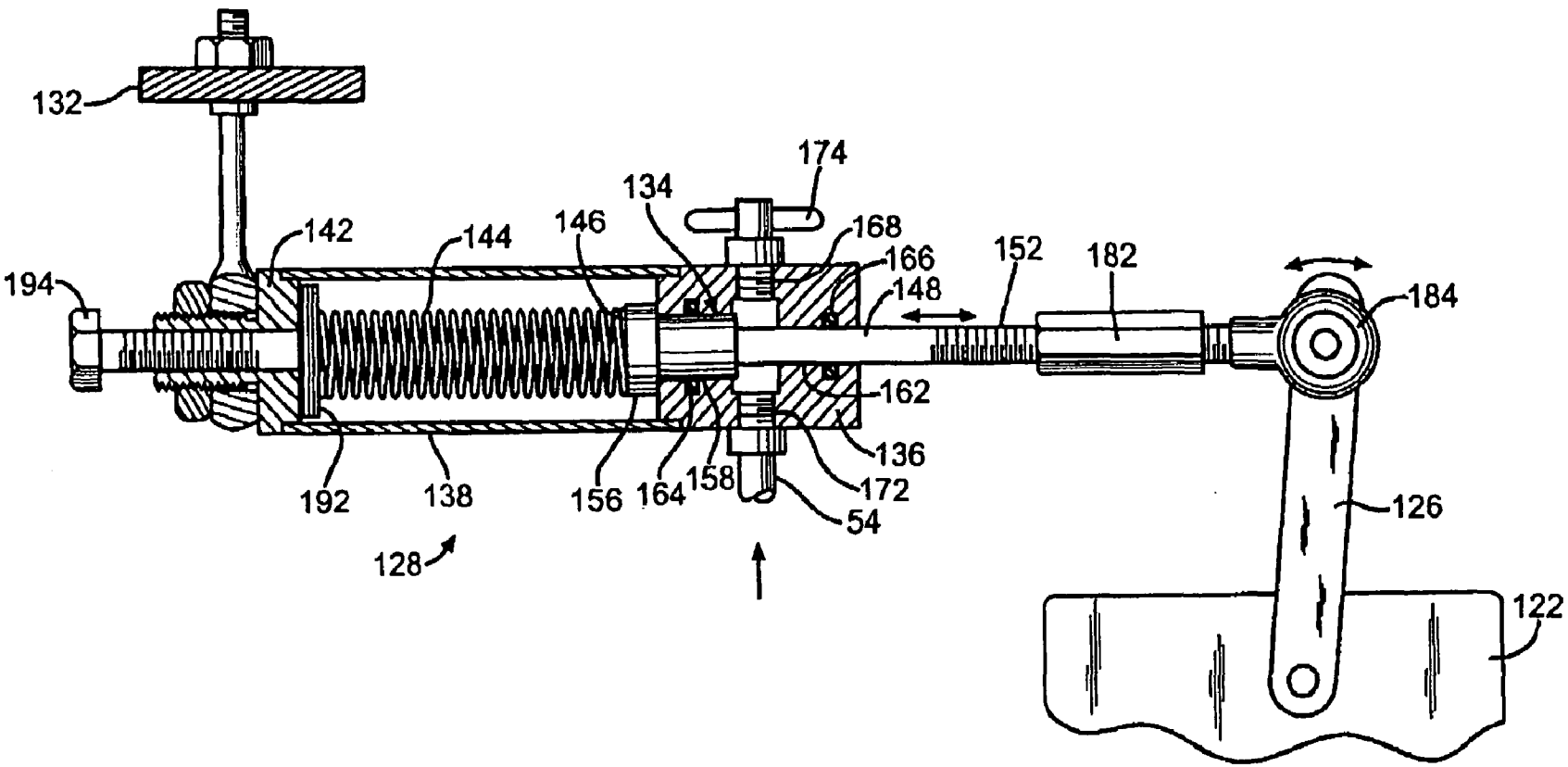
FIG. 4 presents an alternate embodiment wherein the engine throttle is set at full throttle.
Figure 5:
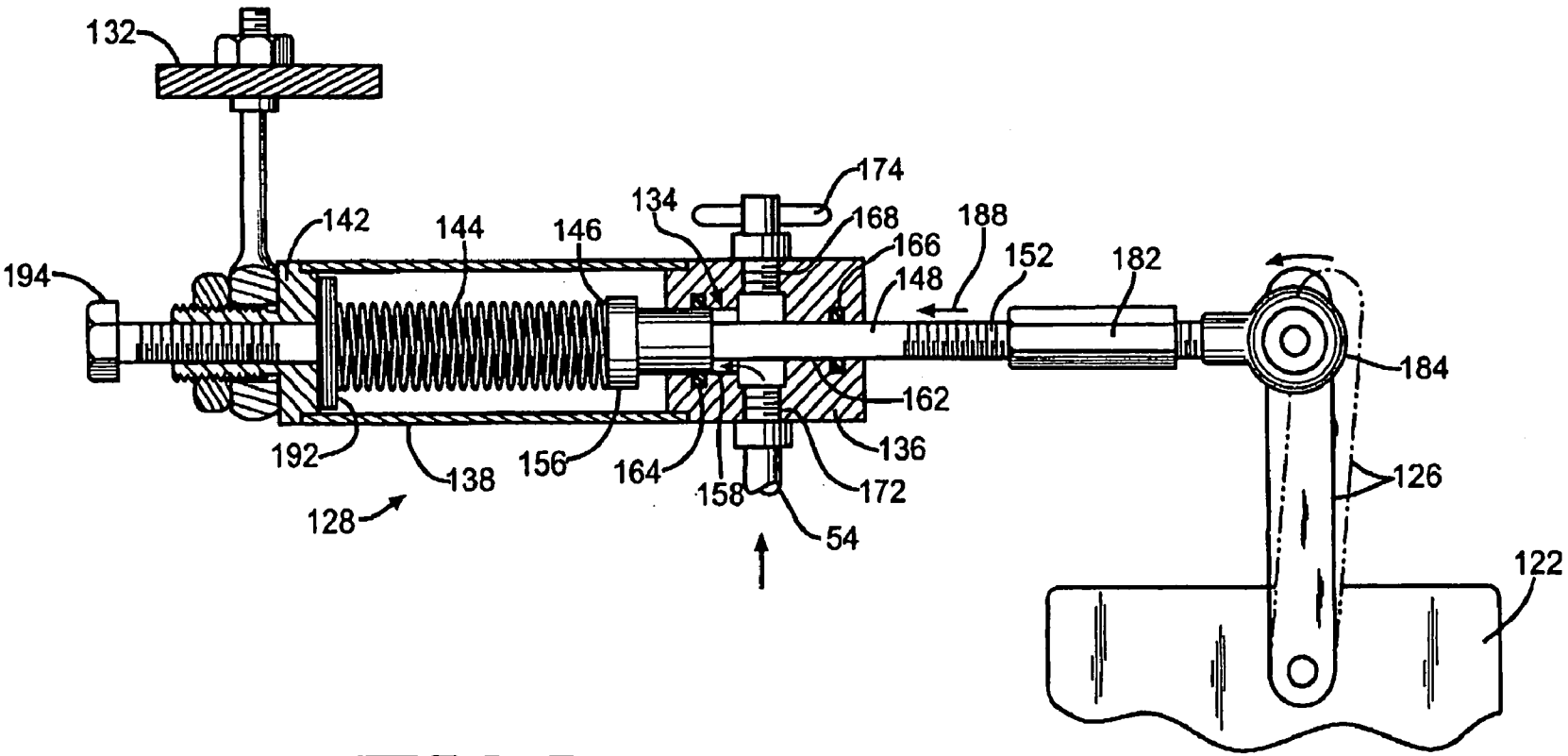
FIG. 5 presents the alternate embodiment illustrated in FIG. 4, wherein the engine throttle has been retarded per the embodiment illustrated in FIG. 4.

An alternate embodiment is illustrated in FIG. 4. The illustrated control mechanism 128 includes a piston 134 which extends through a block 136. Rearwardly of block 136 is a cylindrical casing 138 which screws onto block 136. Opposite block 136 is a cap 142 which screws onto the cylindrical casing 138 holding it in position. Between the cap 142 and the piston 134 is a spring 144 which engages a rear end 146 of piston 134.

Piston 134 includes a shaft 148 having a threaded end 152. The opposite end of piston 134 terminates with a stop member 156 which in turn is larger than the piston 134.

The piston 134 rides in block 136 which includes an enlarged axial first cylindrical chamber 158 and a smaller aligned second cylindrical chamber 162. First and second o-rings 164 and 166 are seated axially in chambers 158 and 162 respectively. Piston 134 is located in the first cylindrical chamber 158 and a seal is formed between piston 134 and the wall of chamber 158 by o-ring 164. The shaft 148 of piston 134 extends through the smaller second chamber 162 and again forms a seal with o-ring 166. The stop member 156 of piston 134 is larger than the large axial chamber 158 and acts as a stop limiting the movement of piston 134 relative to block 136.

Block 136 further includes first and second threaded transverse openings, 168 and 172 respectively which lead to chamber 158. The first threaded opening 168 is sealed by a bleed valve 174. The second threaded opening 172 is connected to tube 54 which extends to pipe 16 which is downstream of pump 14 (Refer to FIG. 1). Tube 54 may further include a strainer.

The threaded end 152 of piston 134 attaches via turnbuckle 182 to throttle control linkage 184 which in turn is attached to the throttle 126. Turnbuckle 182 facilitates on site adjustment at the time of installation or thereafter.

In operation when the engine 22 (FIG. 1) is activated, it will cause pump 14 (FIG. 1) to rotate increasing the water pressure in pipe 16. (FIG. 1) Tubing 54 and chamber 158 of block 136. The water pressure (when it reaches a defined level) within block 136 will force the piston 134 to move to the left pulling the throttle back decreasing the rpm's for the engine and the output pressure from the pump. When the pressure is reduced below a defined pressure, the spring 144 will force the piston 134 back toward its starting position as shown in FIG. 4. The stop member 156 will engage a rear end of block 136 preventing further movement. When stop member 156 engages block 136, the throttle 126 is positioned for the engine to provide its rated speed to drive pump 14 (FIG. 1).

Two mechanisms may be provided to adjust the operation of the control unit 128. Between cap 142 and spring 144 are one or more metal disks or shims 192 which will increase the pressure applied by the spring against the piston 134. By calculating the effect of a shim, one can determine the number of shims needed to achieve the necessary operating pressures. Alternatively, a bolt 194 could be threaded through cap 142 to adjust the pressure on spring 144 as best shown in FIG. 4. Further, turnbuckle 182 can adjust the position of throttle linkage 184 relative to shaft 152. This will permit on site adjustment which may be necessary for engine 22 speed output to be trimmed to match pump 14 speed demand.

The foregoing description provides an uncomplicated mechanism which accounts for increases in the pump pressure caused by changing flow rates, increases in pressure caused by engine droop as well as suction pressure. The simple pressure activated device can be used to compensate for all of these automatically. The system itself does not require multiple adjustments for these three separate factors. This reduces the maximum pressure for a sprinkler system without limiting designed flow rate, which potentially dramatically reduces the cost of a sprinkler system.

The foregoing description makes reference to the details of the illustrated embodiments, however, variations are possible and the scope of protection should only be limited by the claims of any patent issuing on this application.

We claim:

1. A building sprinkler system comprising:

a pump, an internal combustion engine connected for driving said pump, said engine having a throttle attached to a control, said control responsive to output pressure of said pump and adapted to reduce engine speed when the output pressure exceeds a threshold high pressure, said control includes a member operatively connected with said throttle for moving said throttle, said member moveable in response to a fluid pressure condition acting thereon, the fluid pressure condition caused by a fluid pressure path leading from an output side of said pump to said member.

2. The building sprinkler system of claim 1 wherein said control is operatively connected with the output side of said pump via a pressure reducing system, such that when the output pressure of said pump reaches said threshold high pressure the pressure reducing system causes the fluid pressure condition to act on said member and said member moves to effect movement of the throttle and reduction of engine speed, wherein the fluid pressure condition is a pressure substantially reduced from the threshold high pressure.

3. The building sprinkler system of claim 2 wherein the member comprises a piston that is biased into a position to locate the throttle for a normal operating speed, and the fluid pressure condition acting on the piston overcomes the bias on the piston.

4. The building sprinkler system of claim 2 wherein the fluid pressure path including a pressure relief valve therein which opens at the threshold high pressure to permit fluid flow from a pump side of said pressure relief valve to a control side of said pressure relief valve, the pressure reducing system further including a fluid release orifice associated with a portion of the fluid path to the control side of the pressure relief valve, the fluid release orifice acting to reduce pressure along the portion of the fluid pressure path.

5. A building sprinkler system comprising:

a pump, an internal combustion engine connected for driving said pump, said engine having a throttle attached to a control, said control responsive to output pressure of said pump and adapted to reduce engine speed when the output pressure exceeds a threshold high pressure, wherein said control has a piston and said piston is linked to said throttle, wherein said piston moves in response to said output pressure.

6. The sprinkler system claimed in claim 5 wherein said piston is spring biased.

7. The sprinkler system claimed in claim 6 wherein said piston rides in a cylinder having an end wall; and a spring is located between said end wall and said piston urging said piston away from said end wall.

8. The sprinkler system claimed in claim 7 wherein said cylinder includes an end cap and wherein further comprising at least one shim between said cap and said spring.

9. The sprinkler system claimed in claim 5 wherein said piston includes a first cylindrical portion which rides in a cylindrical chamber wherein water from said pump is directed to said chamber and being effective to move said piston at said threshold high pressure.

10. The sprinkler system claimed in claim 9 wherein said piston has a stop member wider than said cylindrical chamber.

11. A sprinkler system comprising:

a) a series of components, said components having a rated pressure limit;

b) a pump connected to an internal combustion engine and having pressure capability which when combined with a system suction pressure exceeds said rated pressure limit of said components;

c) a throttle control responsive to water pressure from said pump, the throttle control adapted to adjust an engine throttle so as to prevent said water pressure from said pump from exceeding the rated pressure of said components.

12. The sprinkler system of claim 11 wherein said throttle control includes a piston that rides in a cylindrical chamber having an end portion wherein said piston extends beyond said end portion and has a stop member having a diameter greater than the diameter of said cylindrical chamber.

13. The sprinkler system of claim 11 wherein the throttle control includes a member connected with said throttle, said member movable in response to a fluid pressure condition acting thereon, said throttle control includes a pressure reducing system associated with an output side of said pump, when said pressure from said pump reaches a threshold pressure said throttle control causes the fluid pressure condition to act on said member, wherein said fluid pressure condition is a pressure substantially reduced from the threshold pressure.

14. The sprinkler system of claim 13 wherein said fluid pressure condition acts on a first side of said member, the throttle control includes a damping mechanism to a second side of said member for damping fluid pressure surges applied to said first side of said member.

15. The sprinkler system of claim 14 wherein the damping mechanism comprises a fluid chamber that communicates with a fluid damping reservoir via an orifice.

16. In a sprinkler system including an engine that drives a pump having an output associated with at least one fluid distribution line of the sprinkler system, the engine including a throttle for engine speed control, a method of controlling engine speed in order to prevent overpressure conditions within the fluid distribution line, the method comprising the steps of:

a) when an output pressure of the pump reaches a threshold high pressure, responsively providing fluid communication between the output side of the pump and a throttle control system;

b) the throttle control system produces a controlled backpressure in response to the fluid communication with the output side of the pump;

c) the controlled backpressure is applied to a movable member to cause the movable member to move;

d) the movable member, which is operatively connected with the throttle, moves the throttle to reduce engine speed when moved per step c);

wherein the controlled backpressure is substantially less than the output pressure of the pump.

17. The method of claim 16 wherein the controlled backpressure is less than fifty percent (50%) of the threshold high pressure.

18. The method of claim 16 wherein during normal operation the controlled backpressure is less than thirty percent (30%) of the threshold high pressure.

19. The method of claim 16 wherein during normal operation the controlled backpressure is less than twenty percent (20%) of the threshold high pressure.

20. The method of claim 16 comprising the further step of detecting a backpressure overpressure condition in the throttle control system and responsively relieving the backpressure overpressure condition releasing fluid from the throttle control system.

21. The method of claim 16 wherein the controlled backpressure produced in step b) varies as the output pressure of the pump varies.

22. The method of claim 21 wherein a variance in the output pressure of the pump over a certain range results in production of the controlled backpressure over a backpressure range that is at least two times larger than the certain range.

23. The method of claim 22 wherein the backpressure range is at least three times larger than the certain range.

24. The method of claim 23 wherein the backpressure range is at least four times larger than the certain range.

* * * * *